United States Patent [19]

Riedel

[11] 4,171,138

[45] * Oct. 16, 1979

[54] SKI BRAKE

[75] Inventor: Tilo Riedel, Eching, Fed. Rep. of Germany

[73] Assignee: S.A. Etablissements Francois Salomon & Fils, Annecy, France

[ * ] Notice: The portion of the term of this patent subsequent to May 2, 1995, has been disclaimed.

[21] Appl. No.: 885,183

[22] Filed: Mar. 10, 1978

Related U.S. Application Data

[63] Continuation of Ser. No. 697,614, Jun. 18, 1976, Pat. No. 4,087,113, which is a continuation-in-part of Ser. No. 557,476, Mar. 12, 1975, Pat. No. 3,989,271.

[30] Foreign Application Priority Data

| | | | |
|---|---|---|---|
| Mar. 4, 1974 | [DE] | Fed. Rep. of Germany | 2412623 |
| Jul. 26, 1974 | [DE] | Fed. Rep. of Germany | 2436155 |
| Feb. 20, 1975 | [DE] | Fed. Rep. of Germany | 2507371 |

[51] Int. Cl.[2] ..... A63C 7/10

[52] U.S. Cl. ..... 280/605

[58] Field of Search ..... 280/605, 604; 188/5

[56] References Cited

U.S. PATENT DOCUMENTS

| | | | |
|---|---|---|---|
| 3,083,028 | 3/1963 | Miller | 280/605 |
| 3,940,158 | 2/1976 | Wehrli | 280/605 |
| 4,087,113 | 5/1978 | Riedel | 280/605 |

FOREIGN PATENT DOCUMENTS

| | | | |
|---|---|---|---|
| 638773 | 3/1962 | Canada | 280/605 |
| 2710539 | 10/1977 | Fed. Rep. of Germany | 280/605 |

*Primary Examiner*—David M. Mitchell
*Attorney, Agent, or Firm*—Karl F. Ross

[57] ABSTRACT

A ski brake for automatic release upon lifiting of a ski boot from the surface of a ski so as to prevent free flight thereof comprises a spring-loaded brake element adapted to reach downwardly below the bottom surface of the ski. A bent wire forms a bight which can be engaged by the ski boot and carries the brake element. A tread plate is disposed on the bight and is connected by another element, e.g. another bent wire, to the mounting structure for the ski brake.

3 Claims, 4 Drawing Figures

SKI BRAKE

CROSS REFERENCE TO RELATED APPLICATION

This application is a continuation of my copending application Ser. No. 697,614 (now U.S. Pat. No. 4,087,113) filed June 18, 1976 as a continuation-in-part of my application Ser. No. 557,476 (now U.S. Pat. No. 3,989,271) filed March 12, 1975.

FIELD OF THE INVENTION

The present invention relates to a device for braking a ski upon its release from a ski boot to prevent free flight of the ski if the bindings become detached. More particularly, the invention relates to a ski brake which becomes effective should the skier fall and the ski become released from the ski boot.

BACKGROUND OF THE INVENTION

As described in the aforementioned copending application, one of the significant dangers involved in skiing, especially on relatively popular ski slopes, is that of release of the ski from the ski boot upon the falling of a skier. Since a free-traveling ski can gain considerable velocity and momentum as it glides downward it can cause significant injury to any person who may come into contact herewith.

To avoid this danger it is not uncommon to connect the ski, apart from the usual bindings to the leg of a skier with a safety strap which prevents complete loss of the ski even if the bindings become released.

It has also been proposed to provide automatic operating ski brakes in which, for example, a pivotal member on the upper surface of the ski carries a lateral brake element or wing which is swung downwardly into an operative position when the ski boot is removed from an actuator. Thus, if the bindings do become released this automatic brake provides a downwardly extending formation below the lower surface of the ski to interfere with free flight thereof.

The conventional ski brakes of this type have several significant disadvantages. Firstly, they are frequently very complicated, expensive and heavy, thereby preventing their widespread use on skis. Secondly, they are not always reliable, have a tendency to ice up and frequently bind or jam so that they are not fully effective.

OBJECT OF THE INVENTION

It is the object of the present invention to provide an improved ski brake, extending the principles set forth in the aforementioned application, which is more reliable, is of simple construction, does not tend to break down, and is free from the jamming or binding phenomena characterizing earlier ski brakes as described above.

SUMMARY OF THE INVENTION

This object and others which will become more apparent hereinafter are attained, in accordance with the present invention, in a ski brake which comprises a support mounted on the upper surface of the ski and in which a bent wire actuator is swingably mounted and carries a brake element or wing adapted to straddle a longitudinal edge of the ski and displaceable, upon swinging movement of the bent wire, between a position in which the brake elements extend generally transversely of the ski and an inoperative position in which the brake element extends generally along the ski.

According to the invention, the bent wire is provided with a tread plate or other boot-engaging structure which is articulated to the bent wire at its bight and is connected via another element to the ski, i.e. via another bent wire structure to the mounting plate.

The significance of the additional connecting element between the tread bight and its plate will be developed more fully below. At this point it is merely necessary to note that the combination of the first bent wire, the tread plate and the second bent wire or for the connecting means has the advantage that it constitutes a four-sided structure which can spring, by its elasticity obtained upon deformation of the structure, from the inoperative position to the operative position.

According to a further feature of the invention, the additional element in a bent-wire structure which is deformed upon displacing the brake from its operative position to its inoperative position so as to act as a force storing means tending to swing the device in the opposite direction, i.e. into its operative position. The support may have a pair of opposing walls lying along the opposite longitudinal edges of the ski and formed with elongated inwardly or outwardly widening openings or cutouts against one flank of which the brake-element carrier tends to bear while the bent-wire additional element has legs bearing against the opposite flank of each opening. The tread plate likewise engages the bights of the two bent wires, at spaced apart locations so that a four-sided kinemetric linkage is provided between the tread plate and the support.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
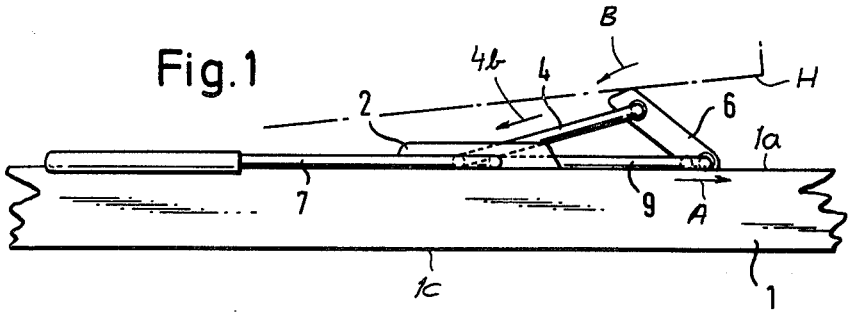
FIG. 1 is a side-elevational view of a ski brake according to the invention with the assembly partly displaced against the ski by a ski boot, a portion of which is shown in dot-dash lines.

In the drawing I have shown a ski brake which is fully described in the above-identified applications to which reference is hereby made for any structure or modifications which may be mentioned but not fully described herein. Basically the device comprises a support plate 2, e.g. of synthetic resin, which may be adjustably mounted upon the upper surface 1*a* of a ski 1. The apparatus further includes a bent wire brake device having a pair of shanks 7 bent at inwardly extending offset portions 7*a* which are inclined at an angle $\beta$ to the longitudinal axis of the ski and a further pair of shanks 9*a* terminates in a thread bight 9. As can be seen from a comparison of FIGS. 2 and 3, the bent wire 7, 7*a*, 9, 9*a* lies in a single plane (FIG. 1) but can be stretched by drawing the bight 9 in the direction of the arrow A to pull the leg 7 inwardly and if the device is properly dimensioned, beyond the longitudinal edges 1*b* of the ski to overlie the surface 1*a*.

Offset portions 7*a* of the bent wire brake actuator are received in passages 5 in the form of elongated openings molded into a pair of lateral walls 2*a* of the U-shaped mounting plate 1. The openings 5 serve, especially in the loaded condition of the spring wire 9, etc., as a seating structure and guide.

The legs 7 can be formed with braking elements 7*b* engageable with the snow surface (see the aforementioned applications).

In the unstressed condition of the spring wire 7, 7*a*, 9*a*, 9, the shanks 9*a* are parallel to the legs 7.

Figure 2:
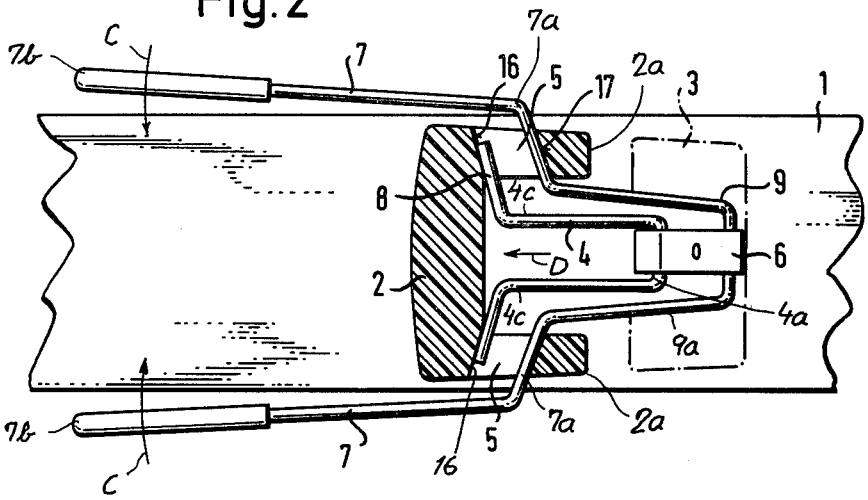
FIG. 2 is a plan view thereof seen in section through the mounting plate.
Figure 3:
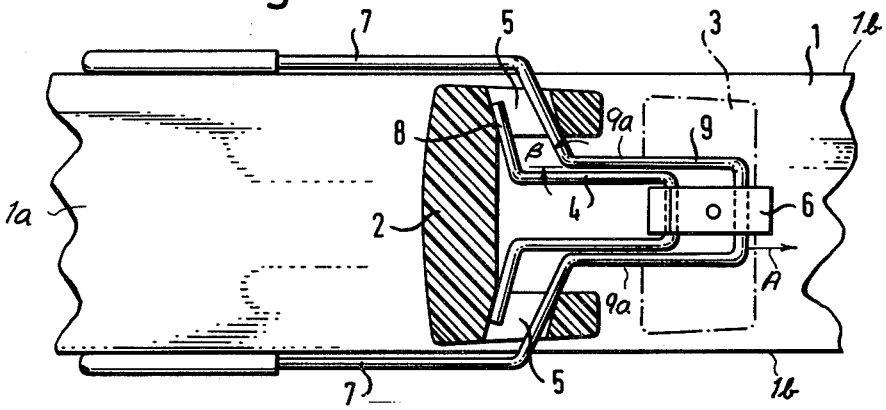
FIG. 3 is a view very similar to FIG. 2 showing the tread plate of the brake fully displaced.

The tread plate 6, which can be extended into a pedal having the contour shown at 3 in FIGS. 2 and 3 is articulated to the bight 9 via its passages 6*a*. The tread plate 6 not only forms a surface which is engageable with, for example, the heel H of a ski boot, but engages the bight 4*a* of a pressure bow or spring wire 4 whose shanks slide along a surface 16 constituting one flank each of the passages 5. The offset portion 7*a* of the main spring wire 9, etc., engages the other flank 17 of the passage 5. A bore 6*b* in tread plate 6 accommodates the bight 4*a*.

Assume that the device has the position shown in FIG. 1, with the heel H of the ski boot having swung the assembly into a position in which the bent wire 7, 9 lies against the surface 1*a* of the ski 1. The auxiliary member 4 assumes a position at an acute angle to the surface 1*a*. When the tread plate is pressed further down it tends to swing in the counterclockwise sense B about bight 9 to thrust member 4 in the direction of 4*b* and spread its shanks 4*c* as its legs 8 ride outwardly along the surfaces 16. At the same time, the bight 9 is shifted in the direction of arrow A and is thereby stretched as its offset portions 7*a* ride along the surface 17. The legs 7 and their brake elements 7*b* are thereby swung inwardly as represented by the arrows C. With proper dimensioning of member 6 it will be apparent that the brake element can be swung fully onto the surface 1*a*, i.e. inwardly of the longitudinal edges 1*b* of the ski.

Figure 4:
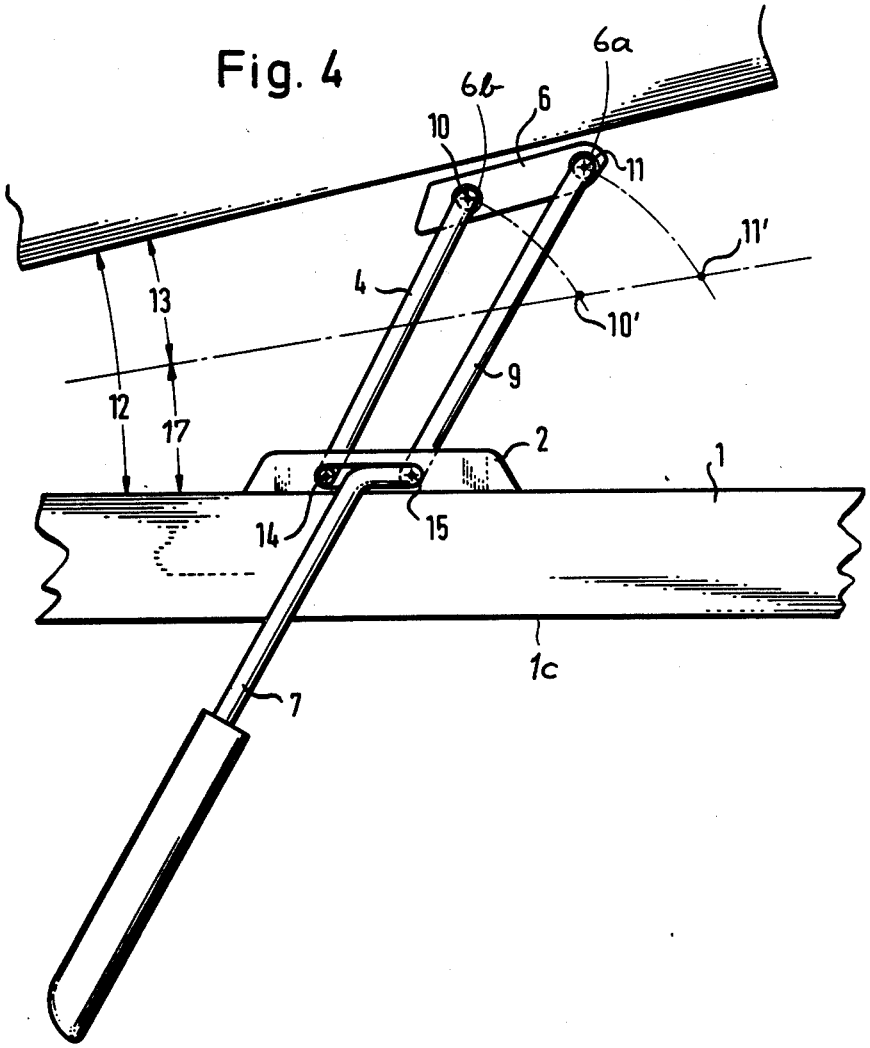
FIG. 4 is a diagram similar to FIG. 1 but showing the result of lifting of the ski boot from the upper surface of the ski.

Since the member 4 is under compression in the direction of arrow D and member 9 is under tension in the direction of arrow A as well as the heel holds the assembly flat against the ski surface 1*a*, the system is intrinsically spring-loaded and tends to swing upwardly in the clockwise sense using the axis 15 as a pivot (see FIG. 4).

From FIG. 4 it will be apparent that points 14 and 15 for the spring wires and 4 and 9 on the plate 2 act as pivots at the corners of a four sided kinemetric linkage structure which has the plate 2 between points 14 and 15 as one side the opposite side of the quadrilateral being the plate 6 with its pivots at 10 and 11. The wires 4 and 9 form the other two sides. When the plate 6 is swung downwardly through the full angle 12 to pressure it against the surface 1*a* of the ski, the bent wires are spring-loaded.

However, if the heel lifts to a limited extent (see FIG. 1) the plate 6 assumes the position shown thereon and remains in contact with the heel without, however, materially swinging the brake elements 7*b* into engagement with the surface below the bottom 1*c* of the ski. Further lifting movement of the heel e.g. through the angle 17, to the point that axes 10 and 11 lie at 10′ and 11′, will cause members 7 to swing downwardly below the surface 1*c*, and place the brake in an operative position. Over the region 13, the plate 6 and the bent wire elements 4 and 9 etc. have almost a true parallelogrammatic motion.

I claim:

1. A brake for a ski automatically operable to prevent free flight thereof upon the release of the ski from a skiboot, said brake comprising:

a support on the upper surface of said ski having a passage;

an actuator comprising first and second bent spring wires engaged in said passage and swingable on said support about respective spaced axes, said spring wires forming a force-storing means tending to swing said actuator into an upstanding position on said support from a rest position by subjecting said first spring wire to greater elastic deformation in said rest position than in said upstanding position, said wires being generally coplanar in one of said positions;

a brake element on one of said spring wires extending transversely to the ski in said upstanding position of said actuator and downwardly into snow underneath said ski, said actuator being displaceable into a position lying along said surface and wherein said element is swung out of its transverse position and said wires into said rest position; and a tread plate connecting said spring wires at spaced pivotal locations and displaceable by said ski boot to press said actuator toward said surface.

2. The brake defined in claim 1 wherein each of said spring wires has a respective bight, said tread plate connecting said bights.

3. The brake defined in claim 2 wherein said one of said spring wires has a pair of such brake elements and the other spring wire is said first wire.

* * * * *

Disclaimer 4,171,138.—*Tilo Riedel,* Eching, Germany. SKI BRAKE. Patent dated Oct. 16, 1979. Disclaimer filed Mar. 2, 1981, by the assignee *S. A. Etablissements Francois Salomon & Fils.*

The term of this patent subsequent to June 22, 1993, has been disclaimed. [*Official Gazette April 7, 1981.*]